United States Patent [19]

Young

[11] Patent Number: 4,783,873

[45] Date of Patent: Nov. 15, 1988

[54] SWEEP MOPS

[75] Inventor: Ronald A. Young, London, England

[73] Assignee: Scot Young Service Systems Limited, Lye, England

[21] Appl. No.: 54,030

[22] Filed: May 26, 1987

[30] Foreign Application Priority Data

May 28, 1986 [GB] United Kingdom ..... 8612959

[51] Int. Cl.[4] ..... A47L 13/258

[52] U.S. Cl. ..... 15/147 A; 15/228; 15/229.6

[58] Field of Search ..... 15/147 R, 147 A, 147 B, 15/147 C, 149, 154, 228, 229.1, 229.2–229.9

[56] References Cited

U.S. PATENT DOCUMENTS

| | | | |
|---|---|---|---|
| 1,178,069 | 4/1916 | Grant | 15/228 |
| 1,526,455 | 2/1925 | Beaudet | 15/149 |
| 1,618,553 | 2/1927 | Saul | 15/229.8 |
| 2,975,451 | 3/1961 | McPherson | 15/147 A |
| 3,458,886 | 8/1969 | Goettel | 15/147 R |
| 4,603,450 | 8/1986 | Osberghaus et al. | 15/147 A |

*Primary Examiner*—Edward L. Roberts

*Attorney, Agent, or Firm*—Collard, Roe & Galgano

[57] ABSTRACT

A sweep mop pad holder comprises a central support section with a handle mounting on its upper side, and two end sections. The end sections are pivotally mounted on the central section and they are engageable with a mop pad which is thereby securely held on the pad holder, with the end sections retained in a generally aligned erected position. One end section is extended inwardly beyond the handle mounting so that whereas with the holder collapsed both end sections can hand down freely for wringing out of the mop pad, the handle can be so positioned relatively to the support section that it engages the inward extension of the one section and can be used to support that end section whereby the mop can be re-erected by engagement of the collapsed mop with the floor by an operative holding the handle.

11 Claims, 3 Drawing Sheets

SWEEP MOPS

BACKGROUND OF THE INVENTION

1. Field of the Invention

The invention relates to sweep mops which comprise a mop pad mounted on a pad holder attached through an articulating joint to a handle, so that the operative area of the pad lies flat on the floor as the mop is used with a sweeping action.

2. Description of the Prior Art

Sweep mops of the foregoing nature, which may typically have an effective size of say 24 or 18 inches by 4 inches, are in general use for mopping of large floor areas as in hospitals and offices. For wet mopping the mop pads are usually removable from the pad holders for use in a wet mopping system including a mopping unit comprising a mop bucket combined with a wringer having two squeeze rollers between which a mop pad can be wrung out. To speed up the mopping operation and avoid the necessity of handling the wet mop collapsible pad holders have been proposed which comprise two leaves hinged to a central support connected to the handle so that, when collapsed, the pad hangs down and can be pulled through the wringer. Although handling is reduced it is not avoided altogether, and individual catch arrangements which respectively retain the two leaves in the erected condition require two-handed operation.

SUMMARY OF THE INVENTION

An object of the invention is to provide a collapsible mop pad holder which can be re-erected, after wringing out the mop, without handling the wet pad. It is a further object to provide such a pad holder which can be collapsed and re-erected without the hands of the operative leaving the mop handle.

According to one aspect of the invention a sweep mop pad holder comprises a support section with a handle mounting on its upper side, two end sections to which the, ends of a mop pad can be attached and catch means which retain the end sections in a generally aligned erected condition, one of the end sections being extended beyond the handle mounting above the support section so that whereas when the holder is collapsed the end sections can hang down for wringing out of an attached mop pad, or the handle can be positioned relatively to the support section so that it or the mounting engages the extension of said one end section for support of that end section so that the mop can be re-erected by engagement of the collapsed mop with the floor with the operative holding the handle.

Preferably the catch means automatically engage as the mop is pressed down on to the floor, so that re-erection is accomplished without the hands leaving the mop handle and, in particular, without touching either the wet mop pad or the pad holder.

The arrangement may be such that the catch can be freed by appropriately positioning the handle and giving it a quick downward and upward shake. This employs the inertia of the wet mop pad to overcome the resilient catch engagement, and a construction results in which the mop can be both collapsed and re-erected without the hands of the operative leaving the handle.

According to another aspect of the invention, a mop pad holder has end sections to which the ends of a mop pad can be attached, and catch means operative to latch the end sections in a generally aligned erected position and which can be freed, to collapse the mop holder, utilising the inertia of a wet pad and merely by appropriate movement of the handle.

Other features of the invention will be apparent from the following description, drawings and claims, the scope of the invention not being limited to the drawings themselves as the drawings are only for the purpose of illustrating a way in which the principles of the invention can be applied. Other embodiments of the invention utilising the same or equivalent principles may be used and structural changes may be made as desired by those skilled in the art without departing from the present invention and the purview of the appended claims.

DESCRIPTION OF THE PREFERRED EMBODIMENT

Figure 1:
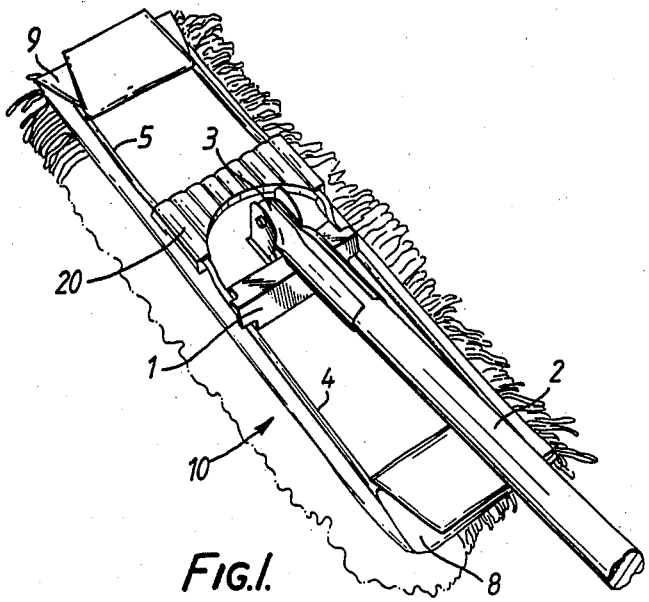
FIG. 1 is a diagrammatic top perspective view showing a complete mop embodying a pad holder in accordance with the invention and in erected condition.

The mop pad holder illustrated comprises a central support section 1 to which a handle 2 is attached by means of a universally-jointed handle mounting 3. End sections 4 and 5, in the form of wire frames, are pivotally mounted on the section 1. The end frame sections 4 and 5 are of rectangular shape in plan view with outer end limbs 6 and 7 which engage in end pockets 8 and 9 of a mop pad 10 which is thereby securely held on the pad holder. In the erected operative condition of the holder the end sections 4 and 5 are aligned, as shown in FIGS. 1 and 4, so that the pad 10 is held stretched in flat configuration below the sections 1, 4 and 5.

Spaced cross members 11 and 12 maintain the shape of the frame section 4, this section having a small central gap 13 between outer end limbs 6. A single cross member 15 of the end section 5 performs the same function as the cross member 12. Both end sections 4 and 5 are formed to provide main outer portions, coplanar with the bottom of the mounting section 1, and relatively short inner portions which are upwardly offset and parallel to the respective outer portions. The cross member 11 of section 4 and the inner end limbs 16 of the section 5 respectively pivotally engage in cross slots 17 and 18 in the lower side of the mounting section 1, being retained therein by an attached securing plate 19.

The upwardly offset inner end portion of the end section 4 extends beyond the handle mounting 3, and a catch block 20 is mounted on the inner end of this section which extends as a close fit into a blind slot 21 moulded into the inner side edge of the plastics block 20. An inner end limb 14 of the section 4 seat against the inner end of the slot 21 which is moulded with internal projections 22 to provide a snap-on fixing of the block 20. The block 20 is moulded with edge recesses 23 in which the side limbs 24 of the upwardly offset inner end portion of the frame section 5 engage. Such engagement operates to provide latching of the sections 4 and 5 one to the other to retain the assembly in the erected condition illustrated in FIGS. 1 and 4. Movement of the side limbs 24 into and out of engagement with the recesses 23, during erection and collapsing of the pad holder, is accommodated by resilient flexing of the side limbs 24 which move over smoothly radiused catch formations 25 at the bottom lateral side edges of the block 20. On its side facing the handle mounting 3 the block 20 has a radiused cut-out 26 so that it does not impede full handle movement during use of the mop.

Figure 4:
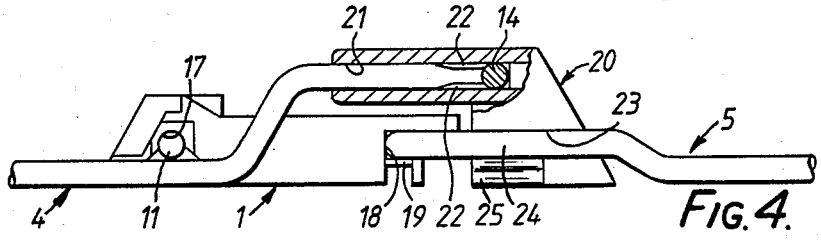
FIG. 4 is a partial side view illustrating a central portion of the pad holder, partly in section.
Figure 5:
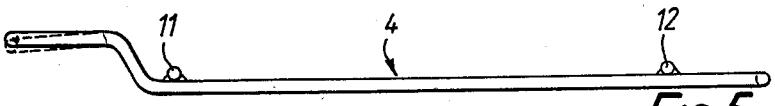
FIGS. 5 and 6 are respectively side and top views of one end section of the pad holder.
Figure 6:
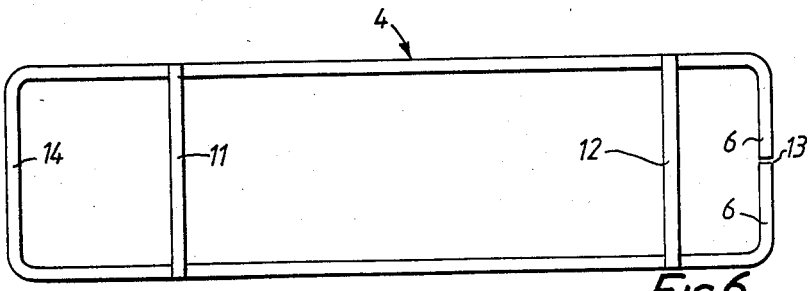
Figure 7:
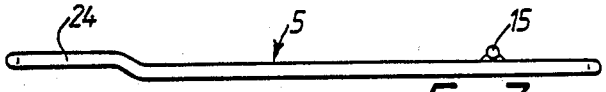
FIGS. 7 and 8 are similar views of another end section of the pad holder.
Figure 8:
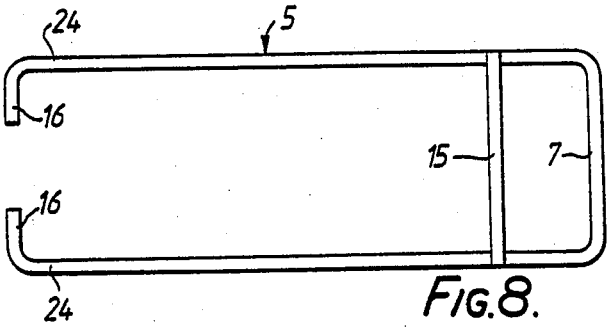
Figure 9:
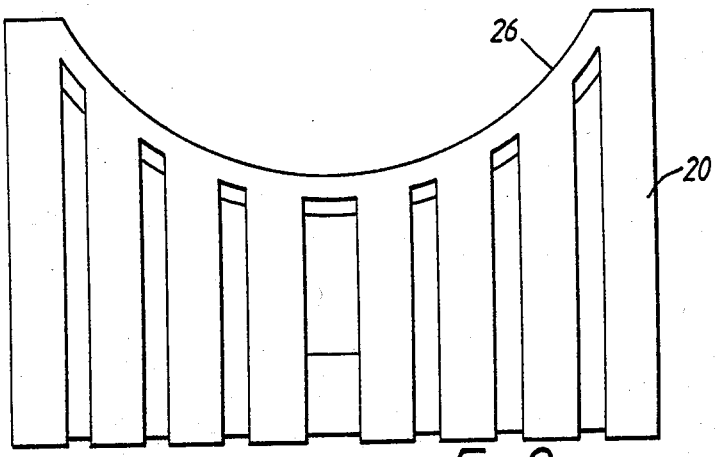
FIGS. 9 and 10 are respectively top and side views of a catch block of the pad holder.
Figure 10:
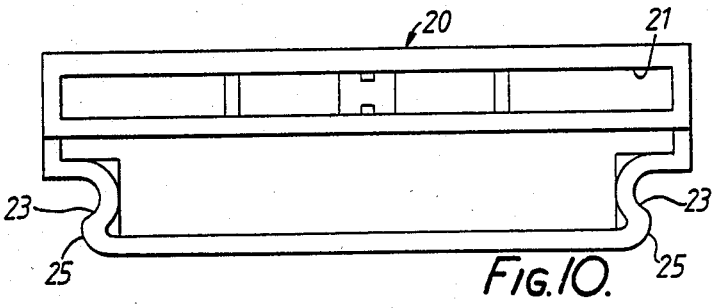

The features of the latch arrangement described are clearly shown in FIGS. 4, 8 and 10, with the handle mounting 3 being omitted from FIG. 4. In addition to providing catch means for latching the sections 4 and 5 one to the other to maintain the erected condition, the block 20 performs another important function which will be clear from the following description of the collapsing and erecting procedure.

Figure 2:
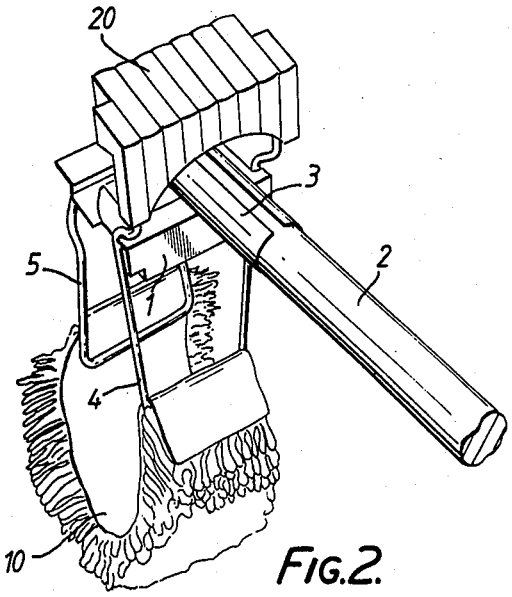
FIG. 2 is a similar view showing the mop in collapsed condition.

When the mop has to be collapsed for wringing out of the mop pad the handle is held positioned as shown in FIG. 1, that is aligned with the longitudinal axis of the pad holder and directed away from the block 20. Holding the handle 2 firmly in both hands the operative gives the mop a quick shake, downwards and upwards. At the reversal of movement the inertia of the wet mop pad 10 acting on the frame sections 4 and 5 is sufficient to overcome the resilient latching engagement of the section 5 with the block 20. The side limbs 24 open to drop down over the latching formations 25 and the sections 4 and 5 hang downwardly, in the collapsed condition of the pad holder, with the mop pad 10 draped in a loop below them as shown in FIG. 2. The mop can now be wrung out, the mop pad 10 being doubled to pass through the wringer. Thus collapsing of the mop and the wringing out can be accomplished without handling of the wet mop pad 10.

Figure 3:
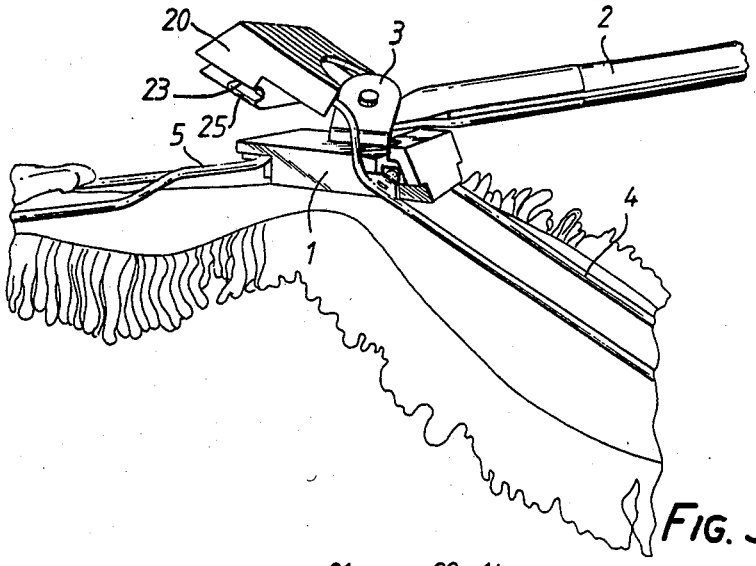
FIG. 3 is a similar view showing the mop partially re-erected.

The handle 2 is now turned through 180°, so that whilst still aligned with the longitudinal axis of the pad holder it extends over the top of the block 20. Thus the handle can be held so that it engages the block 20 to hold the frame section 4 at a suitable inclination for it to be engaged with the floor so that the ends of the pad 10 are spaced apart, whereupon pressing the mop down upon the floor will move the frame sections 4 and 5 back to the erected condition, an intermediate condition being shown in FIG. 3. As the frame sections 4 and 5 come into alignment the side limbs 24 snap over the latching formations 25 into the side grooves 23 of the block 20, so that these sections are securely latched together in the erected condition of the mop holder. Thus erection, after wringing out the mop pad 10, is also accomplished without handling of the latter due to the extension of the end section 4 beyond the handle mounting 3 above the mounting section 1, with this extension terminating in the block 20 engaged by the handle in the manner described. It will be appreciated that whether the block 20 is engaged by the handle itself or by a section of the handle mounting which connects to the handle is immaterial and depends upon the construction of the handle mounting.

What is claimed is:

1. A sweep mop pad holder for a mop pad having two ends, said holder comprising a support section having a handle mounting on its upper side, two end sections which are adapted at outer ends thereof for the attachment thereto respectively of the two ends of the mop pad, said end sections being pivotally mounted to said support section so as to project at opposite ends thereof when in a generally aligned erected position for mopping, means for releasably latching said end sections in said erected position, with one of said end sections having an inward extension beyond said handle mounting and beyond its pivotal mounting to the support section, the arrangement being such that the latching means for said end sections can be unlatched to collapse the mop holder when both of said end sections can hang down freely from the pivotal mounting to said support section for wringing out of the attached mop pad, following which said handle can be so positioned relative to said support section that the handle engages said inward extension of said one end section and can then be used to support said one end section at an inclination to the vertical suitable for the mop to be re-erected with said end sections in said generally aligned mopping position by engagement of the collapsed mop with the floor and pressing down on to the floor by an operative holding the handle.

2. A mop pad holder according to claim 1, wherein said end sections are latched to retain them in said erected position as the collapsed mop is pressed down on to the floor and reaches said erected position.

3. A mop pad holder according to claim 1, wherein said two end sections are directly latched one to the other by said latching means.

4. A mop pad holder according to claim 1, wherein said inward extension of said one end section comprises a moulded block with which said handle can be engaged to support said one end section, said block also including a catch as said latching means which resiliently engages said other end section for latching purposes.

5. A mop pad holder according to claim 4, wherein each of said end sections comprises a wire frame.

6. A mop pad holder according to claim 5, wherein said latching means comprises edge formations formed and disposed on said molded block for snap-on catch engagement with side limbs of the wire frame of said other end section.

7. A mop pad holder according to claim 5, wherein resilient latching engagement with said moulded block employs the flexibility and resilience of the wire frame of said other end section.

8. A mop pad holder according to claim 5, wherein said one end section includes a cross member and said other end section has an inner end limb, said support section having cross slots in which said cross member and said other end limb are respectively pivotally received.

9. A mop holder according to claim 8, wherein a securing plate attached to said support section retains said cross member and said end limb in the respective cross slots in said support section.

10. A mop pad holder according to claim 1, wherein said latching means employs resilient catch engagement of said end sections and the arrangement is such that when the holder is in the erected condition unlatching can be effected by appropriately positioning the handle and giving it a quick downward and upward shake, thereby utilizing the inertia of the wet mop pad to overcome said resilient catch engagement.

11. A sweep mop pad holder according to claim 1, wherein for wringing out of the mop pad with said end sections hanging down freely the handle is positioned extending longitudinally of the support section in one direction, and for supporting said one end section at said inclination to the vertical the handle is turned through 180° to extend longitudinally of the support section in the opposite direction to said one direction.

* * * * *